US006859960B1

(12) United States Patent
Jerome

(10) Patent No.: US 6,859,960 B1
(45) Date of Patent: Mar. 1, 2005

(54) PORTABLE NAP ROLL FOR CHILDREN

(75) Inventor: Peter A. Jerome, Tiverton, RI (US)

(73) Assignee: New Harbour Inc., Fall River, MA (US)

( * ) Notice: Subject to any disclaimer, the term of this patent is extended or adjusted under 35 U.S.C. 154(b) by 0 days.

(21) Appl. No.: 10/753,932

(22) Filed: Jan. 7, 2004

(51) Int. Cl.[7] ..... A47G 9/08; A47G 9/06
(52) U.S. Cl. ..... 5/413 R; 5/419
(58) Field of Search ..... 5/413 R, 413 AM, 5/419, 482; 2/69, 69.5; D6/596

(56) References Cited

U.S. PATENT DOCUMENTS

| | | | | | |
|---|---|---|---|---|---|
| 666,034 | A | * | 1/1901 | Solomon | 2/69.5 |
| 1,263,825 | A | * | 4/1918 | Waugh | 5/413 R |
| 2,358,410 | A | * | 9/1944 | Matthesius | 2/69.5 |
| 2,535,936 | A | * | 12/1950 | Langley | 128/873 |
| 4,375,111 | A | * | 3/1983 | Hall | 5/419 |
| 4,601,076 | A | * | 7/1986 | Knobeloch | 5/413 R |
| 5,050,254 | A | * | 9/1991 | Murphy | 5/625 |
| 5,093,947 | A | * | 3/1992 | Henegar et al. | 5/482 |
| 5,644,807 | A | * | 7/1997 | Battistella | 5/419 |
| D401,736 | S | | 12/1998 | Shaw | D2/719 |
| 6,588,036 | B1 | | 7/2003 | Hort | 5/417 |

OTHER PUBLICATIONS

NapPak Inc.—Online Store, selected pages from website: http://www.mynappak.com/onlinestore.asp; 9 pages.

* cited by examiner

*Primary Examiner*—Alexander Grosz
(74) *Attorney, Agent, or Firm*—Sheridan Ross P.C.

(57) ABSTRACT

A nap roll includes a base panel with padding, and an integral covering or sheet that forms an extension of the base panel but without padding. An integral pillow is provided and attaches to the base panel. The nap roll may be placed in a rolled configuration and secured as by straps. Optionally, a carrying case may be used to store the nap roll when placed in the rolled configuration.

20 Claims, 3 Drawing Sheets

PORTABLE NAP ROLL FOR CHILDREN

TECHNICAL FIELD

The present invention relates to bedding, and more particularly, to a portable nap roll especially adapted for children.

BACKGROUND OF THE INVENTION

The sleeping bag or bed roll is a well known portable bedding complement that allows a person to sleep comfortably without having to sleep in a traditional bed. Sleeping bags are particularly adapted for outdoor activities, and typically include relatively thick upper and lower panels that provide necessary warmth as well as padding for comfort. Sleeping bags also are typically constructed with a zipper for opening or closing the sleeping bag thereby allowing the user to regulate heat within the sleeping bag as generated by the user's body. Bed rolls are similar to sleeping bags in that they allow some portable means for a person to sleep on. However, bed rolls are more traditionally designed for indoor use or outdoor use only in temperate climate conditions.

While traditional sleeping bags and bed rolls may be adequate for their intended purposes, these devices are not well suited for children who require a nap. For sleeping bags, a napping child typically does not require the extra warmth provided by the sleeping bag. Bed rolls are perhaps more suited for napping children; however, bed rolls do not typically include an integral blanket or covering, and therefore a separate blanket may be required to cover the child.

Many children attend daycare while their mothers and fathers work. Particularly in the United States, the number of children who attend daycare has steadily increased over the years. Particularly for children under six years of age, naps may be a mandatory part of the child's day at a daycare facility. One very common way which to accommodate a child for a nap is to provide pads or mats that allow a child to sleep on the floor. Often times, such pads or mats are simply stacked within a daycare room, and the pads are then distributed at nap time. For children who require or desire extra warmth during the nap, separate blankets must be provided in addition to the sleeping pad or mat.

One particular drawback for traditional nap mats used in daycares is that they are not washable because they are most often made of a foam interior and a plastic exterior.

Accordingly, there is a need for a bedding complement that can be used by a child for a nap that not only provides padding for comfort, but may also be washable. There is also a need to provide additional warmth to a napping child in the form of a covering or blanket, that does not also require use of a separate blanket or covering. Finally, there is also a need for a bedding complement that is portable, easily stored, and can be easily manipulated or handled by the child.

SUMMARY OF THE INVENTION

In accordance with the present invention, a portable nap roll is provided that is especially adapted for children. Structurally, the nap roll includes a base pad preferably made of a cloth material and filled with a desired amount of fill material that provides padding. An integral sheet or covering is attached to the base pad, and a pillow is also provided that attaches to the base pad as by a securing strap. Means are provided which allows the nap roll to be rolled up for storage. Optionally, a carrying case or bag can be used to store the nap roll and allows the nap roll to be carried by the child.

Further features and advantages of the present invention will become apparent from a review of the drawings taken in conjunction with the detailed description.

DETAILED DESCRIPTION

Figure 1:
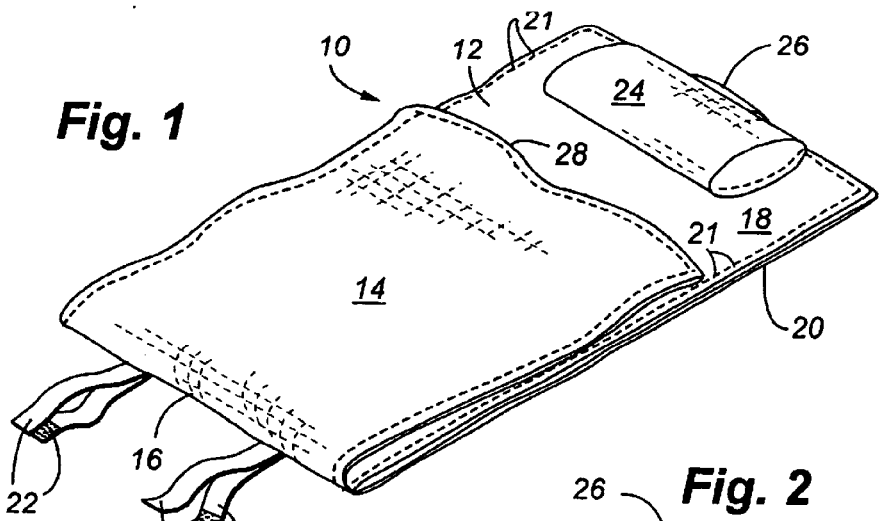
FIG. 1 is a perspective view of the nap roll of the present invention.
Figure 2:
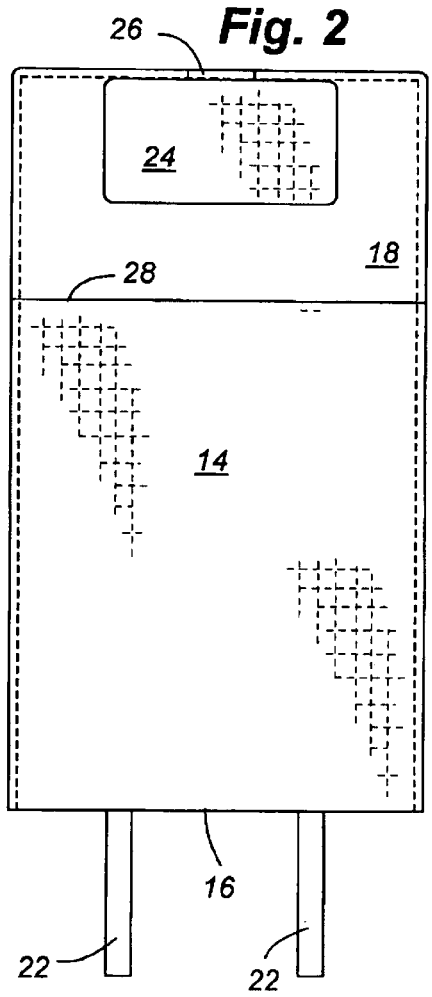
FIG. 2 is an upper plan view of the nap roll.

Referring to FIG. 1, the nap roll 10 of the present invention is shown. The nap roll includes a base pad or panel 12 having an upper piece 18 and a lower piece 20 which are interconnected along their respective edges by stitching 21. The upper and lower pieces form a generally rectangular configuration sized to handle a child. Between the upper and lower pieces is fill or padding material, preferably made of conventional foam. Any stitching pattern may be used to join the upper and lower pieces, and intermediate stitching may be provided across the panels to stabilize the padding to prevent potential settling or slippage of the padding material.

A sheet or covering 14 is provided and is preferably an extension of the upper and lower pieces, but without any fill or padding placed between the two pieces of material. Accordingly, the padding terminates along bottom edge 16. Covering 14 may extend a desired distance, preferably a length that is shorter than the length of the base pad 12. Accordingly, the covering 14 is shown as terminating at edge 28.

There is a distinct advantage in configuring the covering 14 as described. First, a separate piece of material does not have to be provided as a covering; rather, the covering simply constitutes an extension of the base pad 12 thereby simplifying assembly. Furthermore, because the covering 14 only attaches along edge 16, a child can easily crawl under the covering 14 from either lateral side of the nap roll without having to manipulate a zipper, such as the case would be with a standard sleeping bag. Accordingly, the integrally formed covering 14 simplifies both use and construction of the overall nap roll.

As also shown in FIG. 1, an integral pillow 24 may be provided. A pillow strap 26 interconnects the pillow 24 to a top edge of the base panel 12. The pillow 24 may also be filled with the same padding material as used between the upper and lower pieces. The pillow may be sized to accommodate the head of the child.

Figure 3:
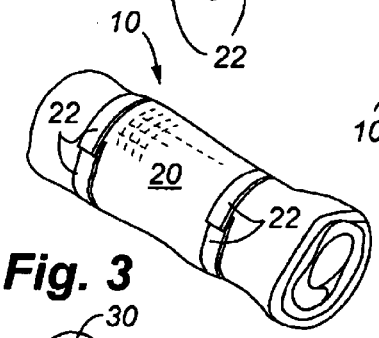
FIG. 3 illustrates the nap roll after it has been rolled.

FIG. 1 also illustrates two pairs of securing straps 22 which extend from edge 16. When the nap roll is rolled as shown in FIG. 3, the straps 22 are used to secure the nap roll. Hook and pile material may be integrated in the straps 22 enabling the straps to secure the nap roll. Alternatively, the straps 22 may simply be tied to one another in order to secure the nap roll.

Figure 4:
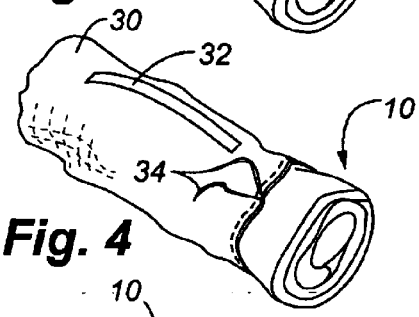
FIG. 4 illustrates the nap roll placed within an optional carrying case.

FIG. 4 illustrates a carrying case or bag 30 that can be used to store the nap roll when rolled. The carrying case 30 is also preferably made of a cloth material and has a cylindrical shape to accommodate the rolled nap roll. The carrying case may include a carrying strap or handle 32 enabling the child to more easily transport the carrying case. Also, the carrying case may include a drawstring 34 that may be drawn to close the carrying case around the enclosed nap roll.

Figure 9:
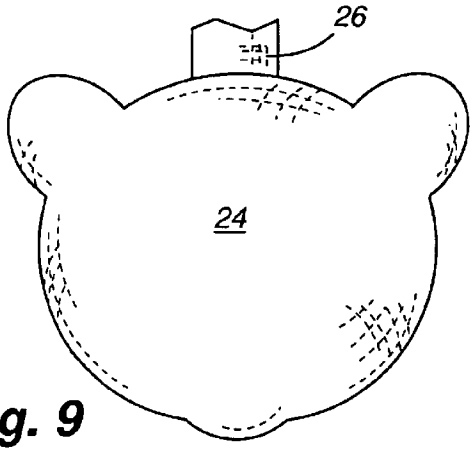
FIG. 9 is a plan view of a pillow of the nap roll in the shape of a bear head.
Figure 10:
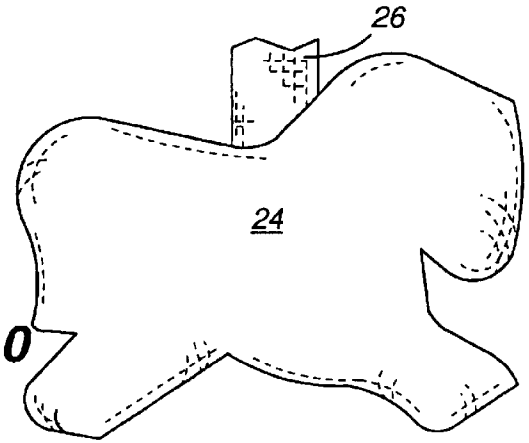
FIG. 10 is a plan view of a of the nap roll in the shape of a horse.
Figure 11:
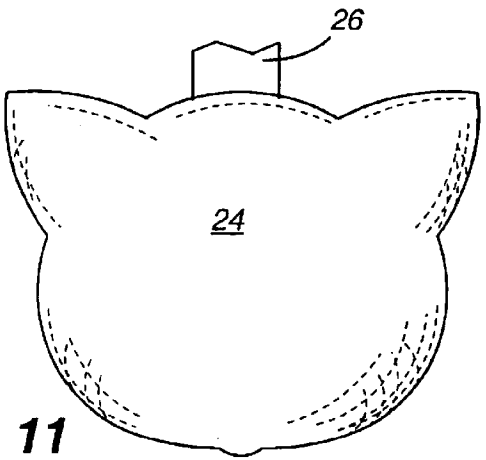
FIG. 11 is a plan view of a pillow of the nap roll in the shape of a cat head.
Figure 12:
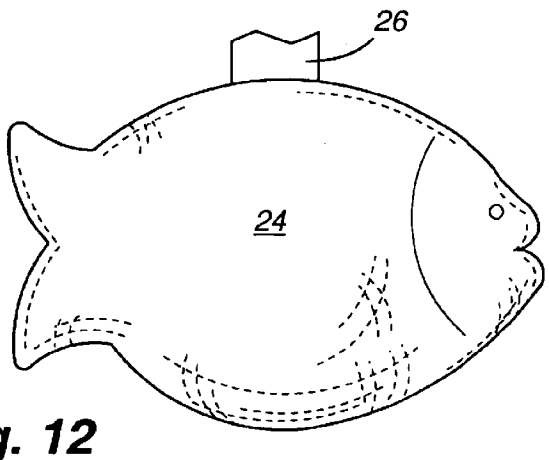
FIG. 12 is a plan view of a pillow of the nap roll in the shape of a fish.

In order to encourage use of the nap roll by a child, the nap roll 10 may include cloth that has pleasing patterns and colors. The pillow 24 may also be shaped to encourage use by the child. For example, the pillow 24 can be formed in the shape of a fish as shown at FIG. 12, and the cloth material may include patterns of tropical fish and the like. The figures also show other pillow shapes that may be used thereby encouraging use by the child. For example, FIG. 9 illustrates a bear head, FIG. 10 illustrates a horse head, and FIG. 11 illustrates a cat.

While there are advantages in configuring the covering 14 as an extension of the upper and lower pieces 18 and 20, it may also be desirable to have the ability to separate the covering 14 from the pieces 18 and 20. If this is desired, the covering 14 during manufacturing can still be constructed as an extension of the upper and lower pieces, but the covering 14 could be then cut or separated from the pieces 18 and 20. Hook and pile material may then be used to attach the covering 14 to the pieces 18 and 20. For example, covering 14 and either the upper piece 18 or lower piece 20 could have a strip of hook or pile material extending along edge 16, thereby providing a user with the ability to remove the covering if necessary. Additionally, it may also be desirable to remove the pillow 24. Accordingly, one end of pillow strap 26 may include hook or pile material, and either the pillow 24 of the adjacent edge of pieces 18 and 20 could include hook or pile material as well.

Figure 5:
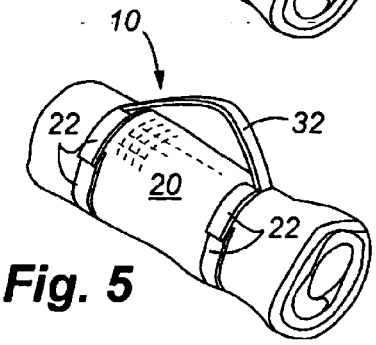
FIG. 5 illustrates the nap roll after it has been rolled along with an optional carrying handle attached directly to the nap roll.
Figure 6:
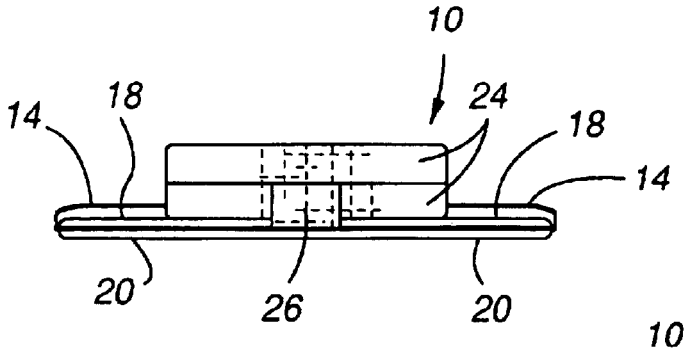
FIG. 6 is an elevation view illustrating attachment of the pillow to the base pad.
Figure 7:
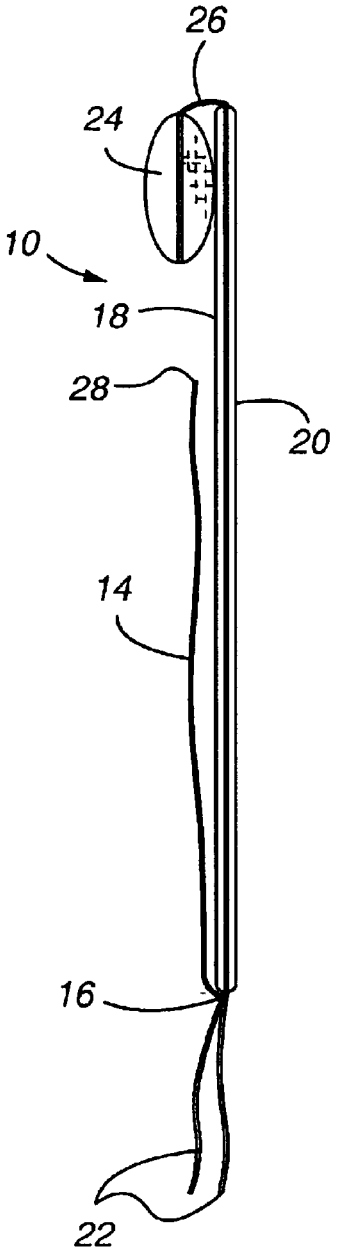
FIG. 7 is another elevation view taken from one side illustrating differences in relative thickness of the base pad as compared to the covering, as well as illustrating how the pillow is attached to the base pad.
Figure 8:
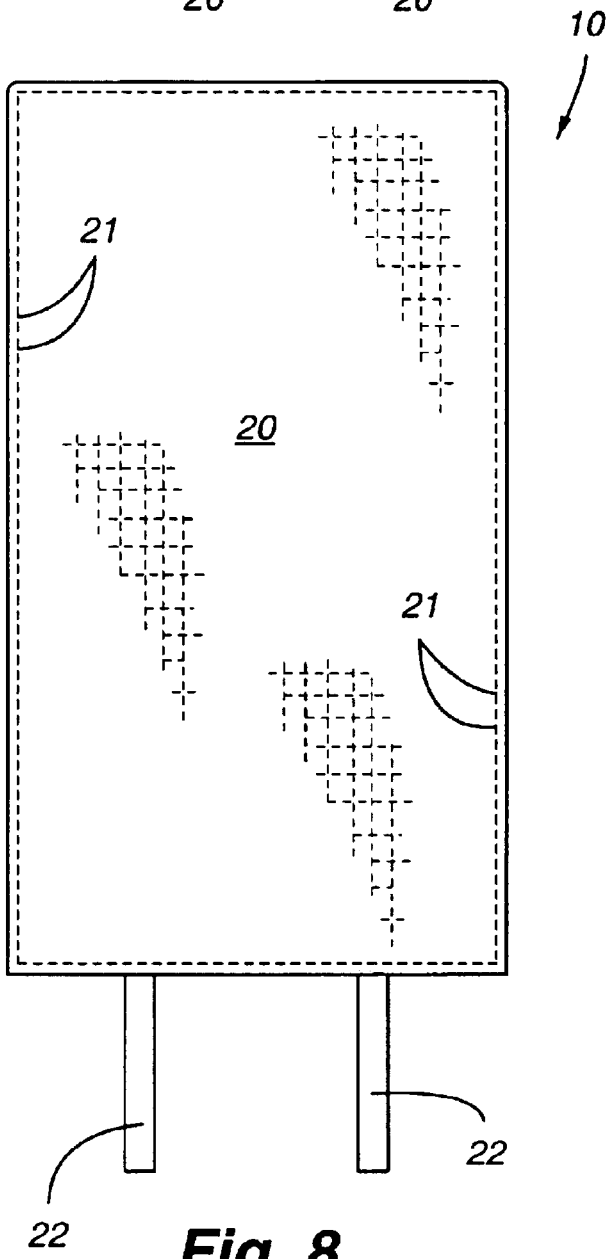
FIG. 8 is a lower plan view.

An alternate means to allow the child to transport the nap roll could be achieved by simply attaching a carrying strap or handle, similar to strap/handle 32, directly to lower piece 20. Accordingly, there would be no need for a separate carrying case or bag 30. FIG. 5 illustrates this alternative arrangement wherein the strap 32 is attached directly to the lower piece 20.

With the nap roll of the present invention, the integral pillow and covering provides a convenient combination allowing the child to take a nap without having to utilize a number of separate items such as a separate pillow and separate blanket. The nap roll to include the optional carrying case is washable. Accordingly, the nap roll provides a more healthful type of bedding as opposed to standard plastic covered pads that are more difficult to sanitize. The invention provides great flexibility in terms of encouraging use of the nap roll by the child. Since the nap roll is made of a cloth material, various patterns and designs can be chosen to suit a particular child. Additionally, the pillow may be shaped to match or otherwise compliment the particular cloth pattern chosen. The manner in which the covering attaches to the base pad not only simplifies overall construction, but also simplifies use of the covering by the child. For storage when the nap roll is not being used, the thinner covering in comparison to the base pad allows the nap roll to be more easily rolled. With sleeping bags that include upper and lower panels of the same thickness, rolling of the sleeping bag for storage is made more difficult because the upper panel includes fill material that adds bulk to the overall bag thickness.

The present invention has been described with respect to a preferred embodiment; however, other changes or modifications may be made within the scope and spirit of the invention.

What is claimed is:

1. A nap roll comprising:

a base pad having a pair of lateral edges, and top and bottom edges, said base pad further including an upper piece, a lower piece, and fill material placed between said upper and lower pieces;

a covering extending from said base pad along said bottom edge;

a pillow;

a pillow strap interconnecting said pillow to said base pad; and wherein said covering forms an extension of said upper piece and said lower piece without fill material being placed between said upper piece and said lower piece at said covering.

2. A nap roll, as claimed in claim 1, further including:

at least a pair of securing straps attached to said nap roll.

3. A nap roll, as claimed in claim 2, wherein:

said straps include hook and pile connections attached thereto.

4. A nap roll, as claimed in claim 1, wherein:

said base pad has a rectangular shape.

5. A nap roll, as claimed in claim 1, wherein:

said covering has a rectangular shape.

6. A nap roll, as claimed in claim 1, further including:

a carrying case.

7. A nap roll, as claimed in claim 6, further including:

a handle attached to said carrying case.

8. A nap roll, as claimed in claim 6, further including:

a draw string attached to an open end of said carrying case.

9. A nap roll, as claimed in claim 1, wherein:

said covering has a width substantially equal to a width of said base pad.

10. A nap roll, as claimed in claim 1, wherein:

said base pad has a thickness greater than a thickness of said covering.

11. A nap roll, as claimed in claim 1, wherein:

said covering has a length that is shorter than a length of said base pad.

12. A nap roll, as claimed in claim 1, wherein:

said upper and lower pieces are constructed of a pair of continuous cloth members, and said covering forms a part of said pair of cloth members.

13. A nap roll, as claimed in claim 1, further including:

a handle attached to said base pad.

14. A nap roll comprising:

a base pad having a pair of lateral edges, top and bottom edges, said base pad further including an upper piece, a lower piece, and fill material placed between said upper and lower pieces;

means forming a covering extending from said base pad along said bottom edge thereof, said upper and lower pieces and said means forming a covering being constructed of a pair of continuous cloth members said covering not including a fill material placed between said upper and lower pieces;

a pillow connected to the base pad.

15. A nap roll, as claimed in claim 14, further including:

at least a pair of securing straps attached to said nap roll.

16. A nap roll, as claimed in claim 14, further including:

a carrying case.

17. A nap roll, as claimed in claim 14, wherein:

said means forming a covering has a width substantially equal to a width of said base pad.

18. A nap roll, as claimed in claim 14, wherein:

said base pad has a thickness greater than a thickness of said means forming a covering.

19. A nap roll, as claimed in claim 14, wherein:

said means forming a covering has a length that is shorter than a length of said base pad.

20. A nap roll, as claimed in claim 14, further including:

a handle attached to said base pad.

* * * * *